US012546515B2

(12) United States Patent
Gehm et al.

(10) Patent No.: US 12,546,515 B2
(45) Date of Patent: Feb. 10, 2026

(54) REFRIGERANT COMPRESSOR FOR AIR-CONDITIONING SYSTEMS AND METHOD FOR OPERATING A REFRIGERANT COMPRESSOR

(71) Applicant: Hanon Systems, Daejeon (KR)

(72) Inventors: Torsten Gehm, Brühl (DE); Erik-Florian Falkus, Burscheid (DE); Dennis Kroecker, Overath (DE); Denis T. G. Wambeogo, Kerpen (DE); Oliver Fischer, Würselen (DE)

(73) Assignee: HANON SYSTEMS, Daejeon (KR)

( * ) Notice: Subject to any disclaimer, the term of this patent is extended or adjusted under 35 U.S.C. 154(b) by 45 days.

(21) Appl. No.: 18/555,703

(22) PCT Filed: Oct. 26, 2022

(86) PCT No.: PCT/KR2022/016416

§ 371 (c)(1),
(2) Date: Oct. 16, 2023

(87) PCT Pub. No.: WO2023/090676

PCT Pub. Date: May 25, 2023

(65) Prior Publication Data

US 2024/0200837 A1 Jun. 20, 2024

(51) Int. Cl.
*F25B 31/02* (2006.01)

(52) U.S. Cl.
CPC ..... *F25B 31/02* (2013.01)

(58) Field of Classification Search
CPC ..... F04C 18/0246; F04C 29/028; F04C 18/0215; F25B 31/02
See application file for complete search history.

(56) References Cited

U.S. PATENT DOCUMENTS

| | | | | |
|---|---|---|---|---|
| 11,073,152 | B2 * | 7/2021 | Kim | F04C 23/008 |
| 11,193,487 | B2 * | 12/2021 | Gutberlet | F04C 18/0246 |
| 2018/0347568 | A1 | 12/2018 | Moon et al. | |
| 2020/0072219 | A1 | 3/2020 | Gutberlet et al. | |

FOREIGN PATENT DOCUMENTS

| | | | |
|---|---|---|---|
| DE | 102019101855 | A1 | 3/2020 |
| JP | 2002213380 | A | 7/2002 |
| JP | 4436236 | B2 | 3/2010 |
| JP | 2010096059 | A | 4/2010 |
| JP | 2010190078 | A | 9/2010 |
| JP | 4754847 | B2 | 8/2011 |
| JP | 5409037 | B2 | 2/2014 |

* cited by examiner

*Primary Examiner* — Sabbir Hasan
(74) *Attorney, Agent, or Firm* — Shumaker, Loop & Kendrick, LLP; James D. Miller

(57) ABSTRACT

A refrigerant compressor for air-conditioning systems and to a method for operating a refrigerant compressor, is based on the object of specifying a solution with which safe functioning of a refrigerant compressor is achieved and in which the effort during production of the refrigerant compressor and the costs are reduced.

9 Claims, 3 Drawing Sheets

REFRIGERANT COMPRESSOR FOR AIR-CONDITIONING SYSTEMS AND METHOD FOR OPERATING A REFRIGERANT COMPRESSOR

CROSS REFERENCE TO RELATED PATENT APPLICATIONS

This is a U.S. national phase patent application of PCT/KR2022/016416 filed Oct. 26, 2022 which claims the benefit of and priority to German Patent Application No. 10 2022 118 029.8 filed Jul. 19, 2022 and German Patent Application No. 10 2021 130 131.9 filed on Nov. 18, 2021, the entire contents of each of which are incorporated herein by reference.

TECHNICAL FIELD

The invention relates to electrical refrigerant compressors for air-conditioning systems, in which a filter is arranged in a region in front of a spiral nozzle insert of the refrigerant compressor, as seen in a direction of the mass flow of a refrigerant of the refrigerant compressor, to prevent blockages in the refrigerant compressor.

The invention also relates to a method for operating a refrigerant compressor, in which particles exceeding a predefined size are filtered out in a region in front of a spiral nozzle insert of the refrigerant compressor, as seen in a direction of the mass flow of a refrigerant of the refrigerant compressor.

BACKGROUND ART

It is known from the prior art that so-called air-conditioning compressors or electrical refrigerant compressors, which are driven by means of an electric motor, are used for air-conditioning vehicles. This applies in particular also to electrically driven or at least partially electrically driven vehicles, such as electric cars or vehicles with a hybrid drive.

In particular, the description relates to electrical refrigerant compressors for air-conditioning systems in vehicles in which filters are used to prevent blockages. Such a filter is used in particular in a region in front of a spiral nozzle insert or a spiral nozzle of the refrigerant compressor, as seen in a direction of the mass flow of a refrigerant of the refrigerant compressor.

It is known from the prior art that a back pressure behind a revolving compressor spiral is necessary for proper operation of such an electrical refrigerant compressor. This back pressure is generated by a mass flow of the refrigerant, which mass flow is regulated by a control valve in combination with a spiral nozzle insert and a spiral nozzle. The spiral nozzle has a reduced cross-section or diameter, as a result of which there is a risk of particles in the refrigerant blocking the spiral nozzle insert or the spiral nozzle. Such a blockage reduces the efficiency of the refrigerant compressor and/or can lead to malfunctions.

DE 10 2019 101 855 A1 discloses a spiral compressor in particular for use in motor vehicle air-conditioning systems. Disclosed in particular is a spiral compressor with an oil recirculation unit, which has a stationary spiral and an orbiting spiral, wherein between the spirals gas is sucked in from a low-pressure space, compressed and conveyed into a high-pressure space. Furthermore, a back pressure space is formed, which is connected to the orbiting spiral and presses the orbiting spiral onto the stationary spiral as back pressure for compression, in order to allow movement of the orbiting spiral in the stationary spiral with the least friction possible by means of a balance of forces.

It is also disclosed that a low-pressure spiral nozzle is formed from a cylindrical cavity in the central housing, which cavity is preferably also designed as a cylinder bore. A spiral nozzle insert is in turn arranged in the cylindrical cavity. The spiral nozzle insert interacts with the wall of the cylindrical cavity such that the spiral nozzle is formed between the surface of the spiral nozzle insert and the wall of the cylindrical cavity. The surface of the spiral nozzle insert preferably has a spiral-shaped groove, which can also be referred to as a coil and forms a spiral-shaped throttle channel in the region where the spiral nozzle insert is in contact with the wall of the cylindrical cavity.

Spiral compressors having a spiral nozzle insert are thus known from the prior art. In such refrigerant compressors, it is also known to arrange a filter in a region of the mass flow in front of the spiral nozzle insert or in front of the spiral nozzle in order to filter particles which can possibly block the nozzle.

It is known to use filters which, according to the prior art, have a typical mesh size of 125 μm, for example, in compressor systems in order to filter out particles which could block the spiral nozzle insert or the spiral nozzle.

The use of such an additional filter requires a corresponding amount of additional installation space, at least one corresponding assembly step for arranging the filter, and thus additional costs in the production of an electrical refrigerant compressor.

There is thus a need for an improved refrigerant compressor for air-conditioning systems and an improved method for operating a refrigerant compressor.

SUMMARY

The object of the invention consists in specifying refrigerant compressors for air-conditioning systems and a method for operating a refrigerant compressor with which safe functioning of a refrigerant compressor is achieved and in which the effort during production of the refrigerant compressor and the costs are reduced.

The object is achieved by subject matter having the features as shown and described herein.

The object is also achieved by a method having the features as shown and described herein.

It is provided for a gap or a gap filter with a defined geometric shape and defined dimensions to be formed in the housing of the refrigerant compressor or in the central housing of the refrigerant compressor in a region in front of a spiral nozzle insert or in front of a nozzle to be protected, as seen in the movement direction of the mass flow of the refrigerant.

To this end, it is provided for the gap or the gap filter to be formed between a housing part of the refrigerant compressor such as a central housing and a friction plate arranged on this housing part. Owing to the arrangement of the friction plate, the gap according to the invention is formed on the one hand and the housing of the refrigerant compressor is sealed on the other hand, so that no refrigerant can escape from the refrigerant compressor. The friction plate can also be exchanged, and in this way the refrigerant compressor can be repaired or adapted to changed operating conditions if required.

Owing to its specific contour and its defined dimensions, the gap or gap filter formed makes it possible for particle sizes which would normally block the spiral nozzle insert or the spiral nozzle to be filtered out. As a result, a separate filter according to the prior art in front of a spiral nozzle insert or a spiral nozzle in the mass flow of the refrigerant is no longer necessary. For the sake of simplicity, only the term gap is used below, which forms the gap filter.

It is provided for the gap to be defined in its dimensions such that particle sizes which would normally lead to the aforementioned blockages are filtered out and on the other hand that the gap is large enough to avoid influencing the mass flow of the refrigerant in its movement or to influence it only insignificantly. The gap formed increases the flow resistance of the flowing refrigerant only insignificantly, and therefore no changes to the dimensioning or the basic design of an existing refrigerant compressor are necessary. The design only has to be adapted in a region of the housing part of the refrigerant compressor in which the friction plate is arranged.

It is provided for the gap to be formed in a ring in a region at the inlet of a spiral nozzle insert by means of an annular molding of the central housing of the refrigerant compressor and the friction plate. The annular gap is arranged centered around a central axis of a bore for a spiral nozzle, wherein the annular gap has an inner diameter which is equal to the diameter of the bore for the spiral nozzle or greater than the diameter of the bore for the spiral nozzle.

Furthermore, it is provided for the housing part or central housing in which the bore for the spiral nozzle is arranged to have an annular molding surrounding the bore, said molding having a trapezoidal or rectangular cross-section. A region of this annular molding which is a circular ring-shaped flat face forms the gap with its filter effect by means of the friction plate arranged parallel to this circular ring-shaped flat face. The friction plate is likewise flat at least in a region of its surface opposite and parallel to the circular ring-shaped flat face. The friction plate can also be completely flat.

In particular, it is provided for the gap forming between the circular ring-shaped flat face of the molding and the friction plate to have a size within the range between 0.1 mm and 0.2 mm, in particular within a range between 0.04 and 0.16 mm.

Furthermore, it is provided for the inner diameter of the circular ring-shaped flat face of the molding to be within a range between 6 mm and 12 mm. The difference between the inner diameter of the circular ring-shaped flat face of the molding and the outer diameter of the circular ring-shaped flat face of the molding, which is also referred to as the width of the circular ring-shaped flat face, is within a range between 1 mm and 3 mm.

Such dimensioning of the gap makes it possible on the one hand to filter out particle sizes which would normally block the spiral nozzle insert or the spiral nozzle and on the other hand to avoid disruptively reducing the mass flow of the refrigerant through the gap as a result of gap blockages.

A gap blockage means the accumulation of particles at the gap, which cannot pass through the gap owing to their dimensions. These accumulations correspond to the filtered particles retained by a filter designed according to the prior art.

In practical experiments, a dimensioning of the gap with the dimensions inner diameter of the circular ring-shaped flat face of 8 mm, outer diameter of the circular ring-shaped flat face of 11 mm, and gap size of 0.15 mm results in a significant influence on the mass flow of the refrigerant of the refrigerant compressor only at a gap blockage rate of greater than or equal to 90%. The mass flow of the refrigerant through the gap and the functional operation of the electrical refrigerant compressor is thus unaffected or only insignificantly affected with gap blockage up to approximately 90%.

The design according to the invention of the gap makes it possible by means of an annular channel for the flow to pass peripherally around the molding forming the gap and thus provides sufficient filter space or filter area so that only partial clogging of the gap (gap blockage) does not affect the mass flow of the refrigerant.

It is provided for there to be produced in the annular channel a peripheral mass flow of the inflowing refrigerant which is as uniform as possible and thus a uniform flow around the annular channel and the molding on all sides. To this end, the inflowing refrigerant is introduced via an inflow first into a side chamber partially flow-connected to the annular channel. From this side chamber, the refrigerant then flows via a transition region into the annular channel. Such a transition region, which extends for example over a circular segment section of the annular channel within a range between 60 degrees and 100 degrees, allows an improved, uniform introduction of the refrigerant over a larger area into the annular channel, in comparison with a direct supply of the refrigerant into the annular channel via the inflow. Owing to the indirect introduction of the refrigerant into the annular channel via the side chamber and the correspondingly sized transition region, turbulence in the mass flow of the refrigerant, as occurs at small openings and/or at edges, is reduced.

In an embodiment according to the invention of the gap with its filter effect, a considerable reduction in the installation space is achieved. Moreover, an additional component such as a filter is not needed. This results in a simplification of the assembly of the electrical refrigerant compressor and in a cost saving in the production of an electrical refrigerant compressor.

BRIEF DESCRIPTION OF DRAWINGS

Further details, features and advantages of embodiments of the invention can be found in the description of exemplary embodiments below with reference to the associated drawings. In the drawings.

DESCRIPTION OF AN EMBODIMENT

Figure 1:
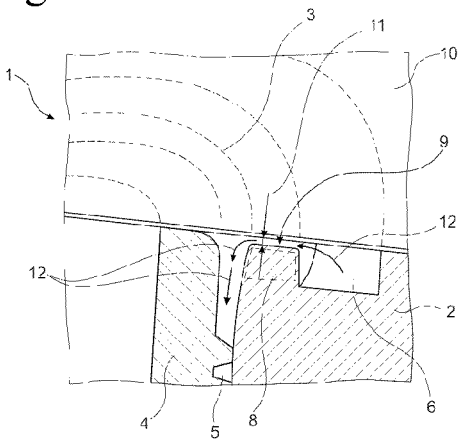
FIG. 1: shows a detail of a region of a refrigerant compressor in which the gap or gap filter is formed, in a sectional diagram.

FIG. 1 shows a detail of a region of a refrigerant compressor (1) in which the gap (11) or gap filter is formed, in a sectional diagram.

FIG. 1 shows a refrigerant compressor (1) with a part of its central housing (2). In the central housing (2), a cylindrical bore (3) has been introduced, in which a spiral nozzle insert (4) with its coils (5) has been introduced. The central housing (2) has an annular channel (6) which runs in a circle around the bore (3) and is connected to an inflow (7) (not shown in FIG. 1 for a refrigerant.

In the central housing (2), between the annular channel (6) and the bore (3) for the spiral nozzle insert (4), a molding (8) is formed surrounding the bore (3), said molding having a trapezoidal or rectangular cross-section. This region of the molding (8) in the central housing (2) is shown in FIG. 1 by means of a dotted line.

The gap (11) or gap filter according to the invention is formed between a circular ring-shaped face (9) of the molding (8) and a friction plate (10) closing the refrigerant compressor (1). To this end, the trapezoidal or rectangular molding (8) in the central housing (2) is designed such that there is a spacing, which is within a range between 0.04 and 0.16 mm, between the circular ring-shaped face (9) of the molding (8) and the friction plate (10).

The refrigerant passing via the inflow (7) into the annular channel (6) moves through the gap (11) and passes into the bore (3) to the spiral nozzle insert (4). This mass flow (12) of the refrigerant is shown in FIG. 1 by means of multiple arrows.

Owing to the provided dimensioning of the gap (11) formed according to the invention, particles exceeding a predefined size are filtered out in that these particles cannot pass via the gap (11) into the region of the spiral nozzle insert (4).

Such particles are thus prevented from blocking the region of the spiral nozzle insert (4) with its nozzle, as is achieved according to the prior art by the use of a separate small-meshed filter.

Figure 2:
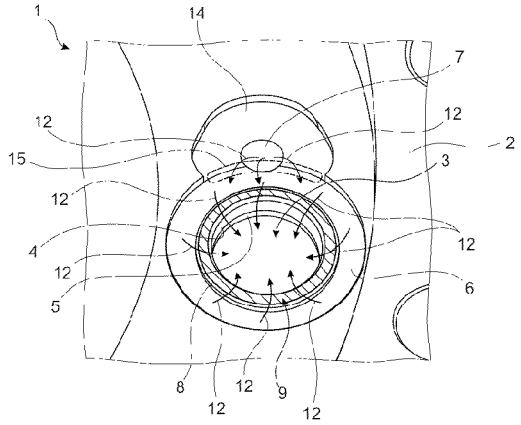
FIG. 2: shows a detail of the region of the refrigerant compressor in which the gap or gap filter is formed in a view from above of the molding for forming the gap.

FIG. 2 shows a detail of the region of the refrigerant compressor (1) in which the gap (11) (cf. FIG. 1) or gap filter is formed. FIG. 2 shows a view from above of the molding (8), which is elevated in a ring shape, for forming the gap (11) with the friction plate (10) removed.

FIG. 2 shows the central housing (2) with the introduced cylindrical bore (3), in which the spiral nozzle insert (4) with its coils (5) is arranged.

Also shown is the annular channel (6) which runs in a circle around the bore (3) and is connected at least indirectly to the inflow (7) for a refrigerant.

It is provided for there to be produced in the annular channel (6) a peripheral mass flow (12) of the inflowing refrigerant which is as uniform as possible and thus a uniform flow around the annular channel (6) and the molding (8) on all sides. To this end, the inflowing refrigerant is introduced via an inflow (7) first into a side chamber (14) partially flow-connected to the annular channel (6). From this side chamber (14), the refrigerant then flows via a transition region (15) into the annular channel (6). Such a transition region (15), which extends for example over a circular segment section of the annular channel (6) within a range between 60 degrees and 100 degrees, allows an improved, uniform introduction of the refrigerant over a larger area into the annular channel (6), in comparison with a direct supply of the refrigerant into the annular channel (6) via the inflow (7). The transition region (15) is indicated in FIG. 2 by means of a dashed line.

Owing to the indirect introduction of the refrigerant into the annular channel (6) via the side chamber (14) and the correspondingly sized transition region (15), turbulence in the mass flow (12) of the refrigerant, as occurs at small openings and/or at edges, is reduced.

In the view from above of FIG. 2, the circular face (9) for forming the gap (11) is also shown. This circular face (9) is part of the molding (8) in the central housing (2) of the refrigerant compressor (1).

Multiple arrows show the mass flow (12) of the refrigerant from the inflow (7) via the annular channel (6) and many points of the annular gap (11) to the spiral nozzle insert (4) with its coils (5).

Figure 3:
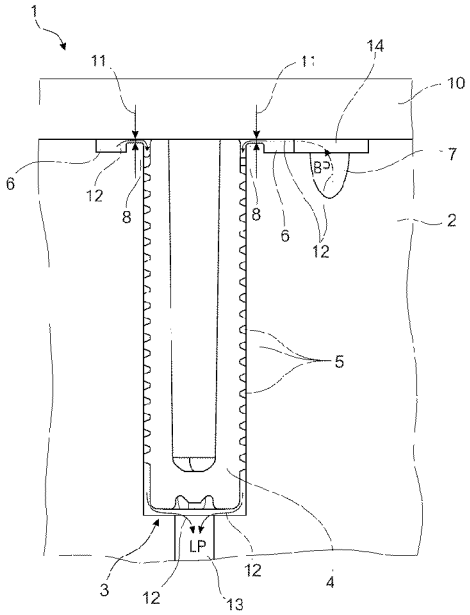
FIG. 3: shows a sectional diagram of the bore for the spiral nozzle insert of the refrigerant compressor with the gap or gap filter formed on the inlet side.

FIG. 3 shows a sectional diagram of the bore (3) in the central housing (2) for the spiral nozzle insert (4) of the refrigerant compressor (1) with the gap (11) or gap filter formed on the inlet side.

On the inlet side means that the gap (11) is formed in a region in which the mass flow (12) of the refrigerant reaches the inlet region of the spiral nozzle insert (4) from the annular channel (6) via the gap (11).

FIG. 3 also shows the friction plate (10) attached to the central housing (2) of the refrigerant compressor (1). It can be seen that the gap (11) is formed between this friction plate (10) and the molding (8) of the central housing (2).

FIG. 3 also shows the side chamber (14) connected to the annular channel (6) and the inflow (7) via which the refrigerant flows into the annular channel (6). In the region of the inflow (7), the letters "BP" stand for a back pressure.

The refrigerant filtered via the gap (11) or gap filter flows through the coils (5) of the spiral nozzle insert (4) and passes to a nozzle-like end (13) shown at the lower end of the spiral nozzle insert (4) in FIG. 3. In this region too, the mass flow (12) is shown by way of example by means of two arrows. In the region of the nozzle-like end (13), the letters "LP" stand for a low pressure.

As is usual in the prior art, the spiral nozzle insert (4) can have a countersunk bore in the region of its central axis, as shown by way of example in FIG. 3.

Figure 4:
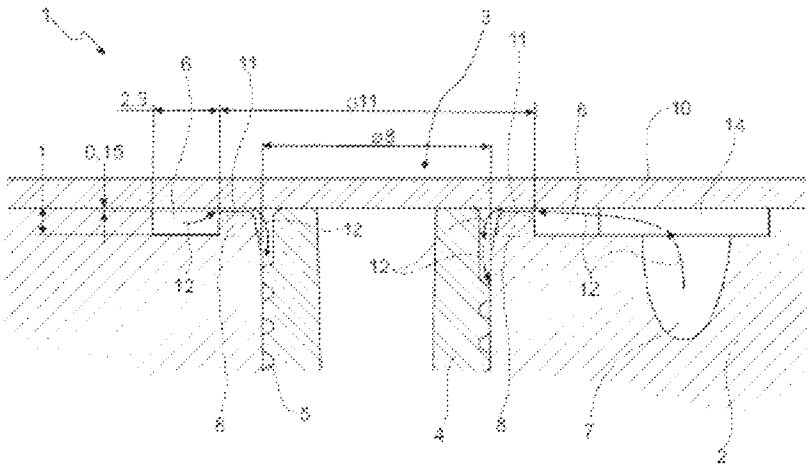
FIG. 4: shows an exemplary dimensioning of the gap or gap filter and of the bore for the spiral nozzle insert of the refrigerant compressor.

FIG. 4 shows a detail of the central housing (2) of the refrigerant compressor (1) in the region of the gap (11) or gap filter and the bore (3) for the spiral nozzle insert (4) with an exemplary dimensioning.

The mass flow (12) of the refrigerant of the refrigerant compressor (1) is also shown in FIG. 4 by means of multiple arrows. The refrigerant flows via the inflow (7) and the side chamber (14) into the annular channel (6). In the example of FIG. 4, this annular channel (6) has an inner diameter of 11 mm and a channel width of 2.3 mm, the channel width having a greater value in the region of the inflow (7). The height of the ring-shaped annular channel (6) is indicated to be 1 mm by way of example.

From this annular channel (6), the refrigerant flows via the likewise annular gap (11) to the spiral nozzle insert (4) with its coils (5). In the example, the gap (11) forming between the molding (8) and the friction plate (10) has a width of 0.15 mm. In FIG. 4, the trapezoidal molding (8) of the central housing (2) is indicated by way of example by means of a dotted line.

In the example of FIG. 4, the spiral nozzle insert (4) with its coils (5) has been introduced into a bore (3) with a diameter of 8 mm and has the countersunk bore already known from FIG. 3.

Figure 5:
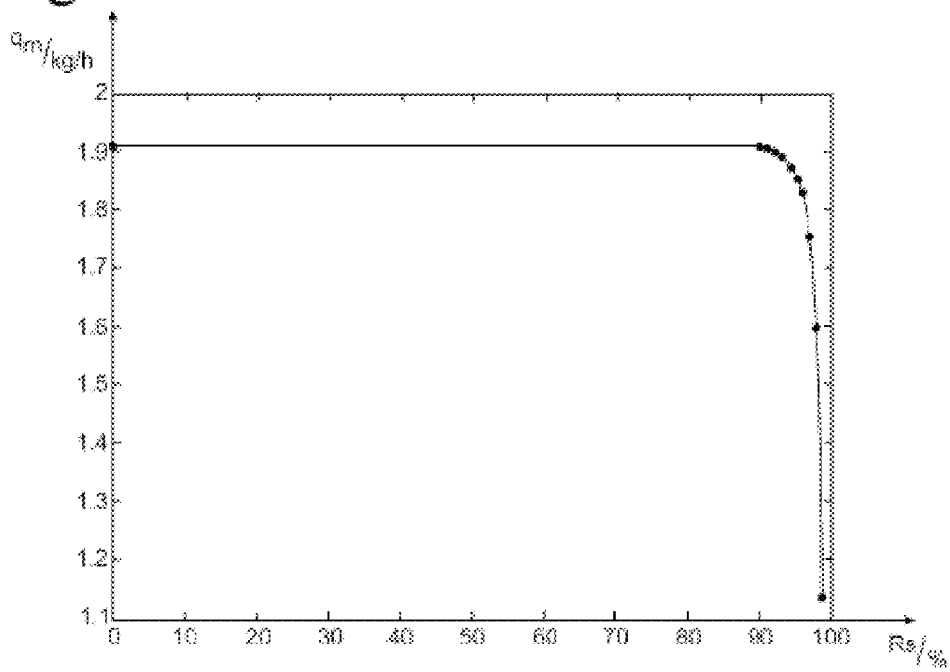
FIG. 5: shows a graph showing the mass flow of a refrigerant through the gap or gap filter as a function of a gap blockage.

FIG. 5 shows a graph showing the mass flow (12) of a refrigerant through the gap (11) or gap filter as a function of a gap blockage.

In the graph of FIG. 5, a gap blockage $R_s$ in % (percent) is shown on the abscissa or x axis. A gap blockage means the accumulation of particles at the gap (11), which cannot pass through the gap (11) owing to their dimensions. These accumulations correspond to the filtered particles retained by a filter designed according to the prior art.

In the graph of FIG. 5, a mass flow or volumetric flow $q_m$ of the refrigerant flowing through the gap (11) in kg/h (kilograms per hour) is shown on the ordinate or y axis.

The graph of FIG. 5 shows the curve of the mass flow or volumetric flow $q_m$ of the refrigerant as a function of the gap blockage $R_s$.

As has been found, an accumulation of particles exceeding a predefined size at the gap (11) has no or only an insignificant effect as long as this gap blockage $R_s$ remains below a rate or a value of 90%.

The volumetric flow $q_m$ of the refrigerant, which is approximately 1.91 kg/h in the example of FIG. 5, thus remains virtually constant in the range of a gap blockage $R_s$ of 0% to 90%. Functional operation of the electrical refrigerant compressor (1) and prevention of blockages by particles exceeding a predefined size are thus ensured within this range.

Only upwards of a gap blockage $R_s$ of more than 90% does a decrease in the volumetric flow $q_m$ of the refrigerant occur, which can have a negative effect on the operation of the electrical refrigerant compressor (1). In the case of a gap blockage $R_s$ of approximately 95%, the volumetric flow $q_m$ of the refrigerant is thus reduced to a value of approximately 1.85 kg/h, which corresponds to a reduction in the volumetric flow $q_m$ of the refrigerant of approximately 3%. In the case of a gap blockage $R_s$ of approximately 98%, the volumetric flow $q_m$ of the refrigerant is reduced to a value of approximately 1.6 kg/h, which corresponds to a reduction in the volumetric flow $q_m$ of the refrigerant of approximately 16%.

The diagram shows that the safe operation or functional safety of the gap filter according to the invention formed by the gap (11) is ensured over a very wide range of a gap blockage $R_s$.

LIST OF REFERENCE NUMERALS

1 Refrigerant compressor
2 Central housing
3 Bore
4 Spiral nozzle insert
5 Coils
6 Annular channel
7 Inflow
8 molding
9 Circular ring-shaped face
10 Friction plate
11 Gap
12 Mass flow
13 Nozzle-like end
14 Side chamber
15 Transition region

The invention claimed is:

1. A refrigerant compressor for an air-conditioning system, comprising:

a filter arranged in a region in front of a spiral nozzle insert of the refrigerant compressor, as seen in a direction of a mass flow of a refrigerant of the refrigerant compressor, to prevent blockages in the refrigerant compressor, wherein an annular channel surrounding a molding is arranged on a central housing of the refrigerant compressor, that the molding has a circular ring-shaped flat face, and that a friction plate is arranged parallel to the circular ring-shaped flat face, wherein a gap acting as the filter is formed between the circular ring-shaped flat face and the friction plate.

2. The refrigerant compressor according to claim 1, wherein the annular channel is connected via a side chamber to an inflow for the refrigerant of the refrigerant compressor.

3. The refrigerant compressor according to claim 1, wherein a bore, in which the spiral nozzle insert is placed, is arranged inside the molding in the central housing of the refrigerant compressor.

4. The refrigerant compressor according to claim 1, wherein the molding has a trapezoidal or rectangular cross-section.

5. The refrigerant compressor according to claim 1, wherein a size of the gap is within a range between 0.1 mm and 0.2 mm.

6. The refrigerant compressor according to claim 1, wherein an inner diameter of the circular ring-shaped flat face of the molding is within a range between 6 mm and 12 mm, and that a width of the circular ring-shaped flat face of the molding is within a range between 1 mm and 3 mm.

7. A method for operating a refrigerant compressor, in which particles exceeding a predefined size are filtered out in a region in front of a spiral nozzle insert of the refrigerant compressor, as seen in a direction of a mass flow of a refrigerant of the refrigerant compressor, wherein an annular channel surrounding a molding is provided in a central housing of the refrigerant compressor, that the molding is provided with a circular ring-shaped flat face, and that a friction plate is provided parallel to the circular ring-shaped flat face, as a result of which a filter which retains the particles exceeding the predefined size is formed by a gap between the circular ring-shaped flat face and the friction plate.

8. The method according to claim 7, wherein the mass flow of the refrigerant takes place via a side chamber with an inflow into the annular channel via the gap into the spiral nozzle insert provided in a bore, wherein the particles exceeding the predefined size are retained by the gap and thus do not reach the region of the spiral nozzle insert.

9. The method according to claim 7, wherein the gap is provided with a size between 0.1 mm and 0.2 mm.

* * * * *